US010029702B2

(12) United States Patent
Richard

(10) Patent No.: US 10,029,702 B2
(45) Date of Patent: Jul. 24, 2018

(54) DEVICE FOR ATTACHING A CABIN DESIGNED TO BE HAULED BY A CABLE, VEHICLE EQUIPPED WITH SUCH A DEVICE, AND INSTALLATION FOR TRANSPORTING BY CABLE COMPRISING ONE SUCH VEHICLE

(71) Applicant: POMA, Voreppe (FR)

(72) Inventor: Jérôme Richard, Crolles (FR)

(73) Assignee: POMA, Voreppe (FR)

( * ) Notice: Subject to any disclaimer, the term of this patent is extended or adjusted under 35 U.S.C. 154(b) by 344 days.

(21) Appl. No.: 14/877,682

(22) Filed: Oct. 7, 2015

(65) Prior Publication Data

US 2016/0114813 A1 Apr. 28, 2016

(30) Foreign Application Priority Data

Oct. 15, 2014 (FR) ..... 14 59886

(51) Int. Cl.

| | |
|---|---|
| ***B61B 12/02*** | (2006.01) |
| ***B61B 9/00*** | (2006.01) |
| ***B61B 5/00*** | (2006.01) |
| ***B61B 7/00*** | (2006.01) |

(52) U.S. Cl.

CPC ..... *B61B 12/02* (2013.01); *B61B 5/00* (2013.01); *B61B 7/00* (2013.01); *B61B 9/00* (2013.01); *B61B 12/028* (2013.01)

(58) Field of Classification Search

CPC ..... B61B 12/02; B61B 12/002; B61B 12/005; B61B 12/028; B61B 5/00; B61B 7/00; B61B 9/00; B61B 3/00; B61B 11/00

USPC ..... 105/148, 149, 149.1, 148.2, 149.2; 104/172.3, 173.1, 76, 74, 85, 62, 67

See application file for complete search history.

(56) References Cited

U.S. PATENT DOCUMENTS

| | | | | |
|---|---|---|---|---|
| 3,036,531 | A * | 5/1962 | Schule | B61B 12/02 104/180 |
| 4,784,065 | A * | 11/1988 | Brochand | B61B 12/002 104/173.2 |
| 6,427,601 | B2 * | 8/2002 | Albrich | B61B 7/00 104/173.1 |
| 2006/0060107 | A1 | 3/2006 | Schertler | |
| 2009/0107357 | A1 | 4/2009 | Richard | |

FOREIGN PATENT DOCUMENTS

| | | | |
|---|---|---|---|
| EP | 1 640 235 | A1 | 3/2006 |
| FR | 2 754 229 | A1 | 4/1998 |
| FR | 3 001 432 | A1 | 8/2014 |
| JP | 2005-029081 | A | 2/2005 |
| WO | 2007/118975 | A1 | 10/2007 |

* cited by examiner

*Primary Examiner* — Mark T Le

(74) *Attorney, Agent, or Firm* — Oliff PLC

(57) ABSTRACT

Device for attaching a cabin designed to be hauled by a cable, including a fastener to couple the device to the cable, and at least one arm configured to attach the cabin in removable manner and mounted mobile on the fastener to move the cabin with respect to the fastener.

12 Claims, 6 Drawing Sheets

DEVICE FOR ATTACHING A CABIN DESIGNED TO BE HAULED BY A CABLE, VEHICLE EQUIPPED WITH SUCH A DEVICE, AND INSTALLATION FOR TRANSPORTING BY CABLE COMPRISING ONE SUCH VEHICLE

BACKGROUND OF THE INVENTION

The invention relates to attachment of cabins designed to be hauled by a cable, and more particularly to cabins designed for transporting passengers.

STATE OF THE ART

Aerial cableways, such as chairlifts and gondola lifts, currently exist that are detachable so as to improve the rate of transport of passengers compared with aerial cableways called fixed grip cableways. Detachable aerial cableways comprise vehicles that are fitted removable on the hauling cable, and fixed grip aerial cableways comprise vehicles mounted fixed on the hauling cable. In both cases, the order of the on-line vehicles, when the latter are conveyed along the hauling cable, is imposed over the whole of the route. What is meant by on-line vehicle is a vehicle coupled to the hauling cable of the installation.

Japanese Patent application JP2005029081 describes transport equipment hauled by a cable comprising a support of a cabin rotating around a vertical axis, the cabin being mounted on the support so as to rotate around a horizontal axis. French Patent application FR2754229 discloses a section of line of aerial cableway type comprising a cabin suspended in pendular manner by a pole of variable length on a running gear running on a carrying cable, and a hauling cable to make the cabin advance along said section of line of aerial cableway type. The pole comprises a chassis provided with four wheels driven by a motor, and the cabin comprises two longitudinal rails resting on the wheels in order to move the cabin longitudinally with respect to the chassis to recentre the centre of gravity of the cabin perpendicularly to the pole in order to enhance user comfort. European Patent application EP1640235 discloses a device for fixing a car of an aerial cableway installation to a suspension arm provided at its top end with a coupling jaw which collaborates with a hauling cable, the car being provided with two oscillating arms the ends of which are articulated on the car and on the suspension bar so as to prevent pendular movements of the car and to enhance passenger comfort. But these documents do not enable the rate at which the passengers are transported to be improved.

French Patent FR1300193 can be cited which discloses an aerial cable transport system comprising vehicles provided with four wheels and with a detachable attachment means to attach the vehicles to the aerial cable in order to enable hauling of the vehicles, and to detach them from the aerial cable so that the vehicles can run on the ground. But such a transport system does not enable the rate at which the passengers are transported to be improved.

International Patent WO2007/118975 can be cited which discloses an automatic transport installation by cable of detachable type comprising a detached circuit where the vehicles are driven at slow speed and in which each station comprises an automatic operating mechanism designed to extract the vehicles from the detached circuit and to transfer them to a loading/unloading station so as not to block movement of the other vehicles running in the detached circuit. But if the unloading station is occupied by a vehicle that is stopped, the following vehicle can no longer be extracted to the occupied station. The installation is therefore complex as at least two loading/unloading stations have to be provided. Furthermore, the installation is not suitable for improving the rate at which the passengers are transported in sufficient manner.

OBJECT OF THE INVENTION

One object of the invention consists in remedying these shortcomings, and more particularly in providing means for improving the transport rate of persons by cable, in particular for aerial cableways with fixed grips.

Another object of the invention consists in providing means for preventing a cabin, stopped in the normal running path of the vehicles in a station of a cable transport installation, from blocking running of another cabin in the station.

According to one feature of the invention, a device is proposed for attaching a cabin designed to be hauled by a cable, comprising attachment means to couple the device to the cable.

The device comprises at least one arm configured to attach the cabin in removable manner and mounted mobile on the attachment means to move the cabin with respect to the attachment means.

An attachment device is thus provided which enables a cabin of an on-line vehicle to be detached, and a cabin that is stopped in the terminal station of the installation to be attached, and in particular anywhere in the station. The passenger throughput rate can thus be increased as the latter can embark in the stopped cabin, and the device then attaches this cabin with a minimum stopping time. By increasing the installation throughput rate, the size of the cabins can be reduced, which simplifies the installation even further. Advantageously, a first cabin which is running in a station of the installation can avoid a second cabin which is stopped in the station by moving the first cabin, while at the same time continuing to haul it in the station. By means of such an attachment device, driving of the hauling cable can be kept and the order of the cabins along the hauling cable can be changed. Collisions between cabins in a station can then be avoided. Such a device enables the loading/unloading time of passengers to be mastered without influencing hauling of the other vehicles.

The device comprises at least one slide fixed to the attachment means, and said at least one arm is mounted sliding in said at least one slide to move the cabin which it latches perpendicularly to a direction of movement of the attachment means.

Said at least one arm is mounted sliding in said at least one slide along an axis perpendicular to a vertical axis and to a coupling axis of the attachment means.

The device can comprise two slides fixed to the attachment means and two arms mounted respectively sliding in the slides, each arm being configured to move the cabin which it latches perpendicularly to a direction of movement of the attachment means.

The two arms are mounted sliding in the slides along respectively two axes perpendicular to the vertical axis and to the coupling axis of the attachment means.

The device can comprise an actuator to make the arms slide in two opposite directions.

The device can further comprise stabilising means to stabilise the attachment means when the cabin is moved with respect to the attachment means.

According to another feature of the invention, a vehicle is proposed designed to be hauled by a cable, comprising:

an attachment device as defined in the foregoing; and a cabin attached to at least one arm of the attachment device.

The cabin can comprise support means to keep the cabin immobile when it is detached from said at least one arm.

The cabin can be configured for transportation of people.

According to another feature of the invention, an installation for transporting by cable is proposed comprising at least one vehicle as defined in the foregoing.

The cable can be located above or below the cabin of said at least one vehicle.

The installation can comprise two terminal stations and the cable forms a closed loop between the two terminal stations.

The attachment means of said at least one vehicle can be configured to couple the attachment device of said at least one vehicle to the cable in removable manner.

BRIEF DESCRIPTION OF THE DRAWINGS

Other advantages and features will become more clearly apparent from the following description of particular embodiments of the invention given for non-restrictive example purposes only and represented in the appended drawings, in which.

DETAILED DESCRIPTION

Figure 1:
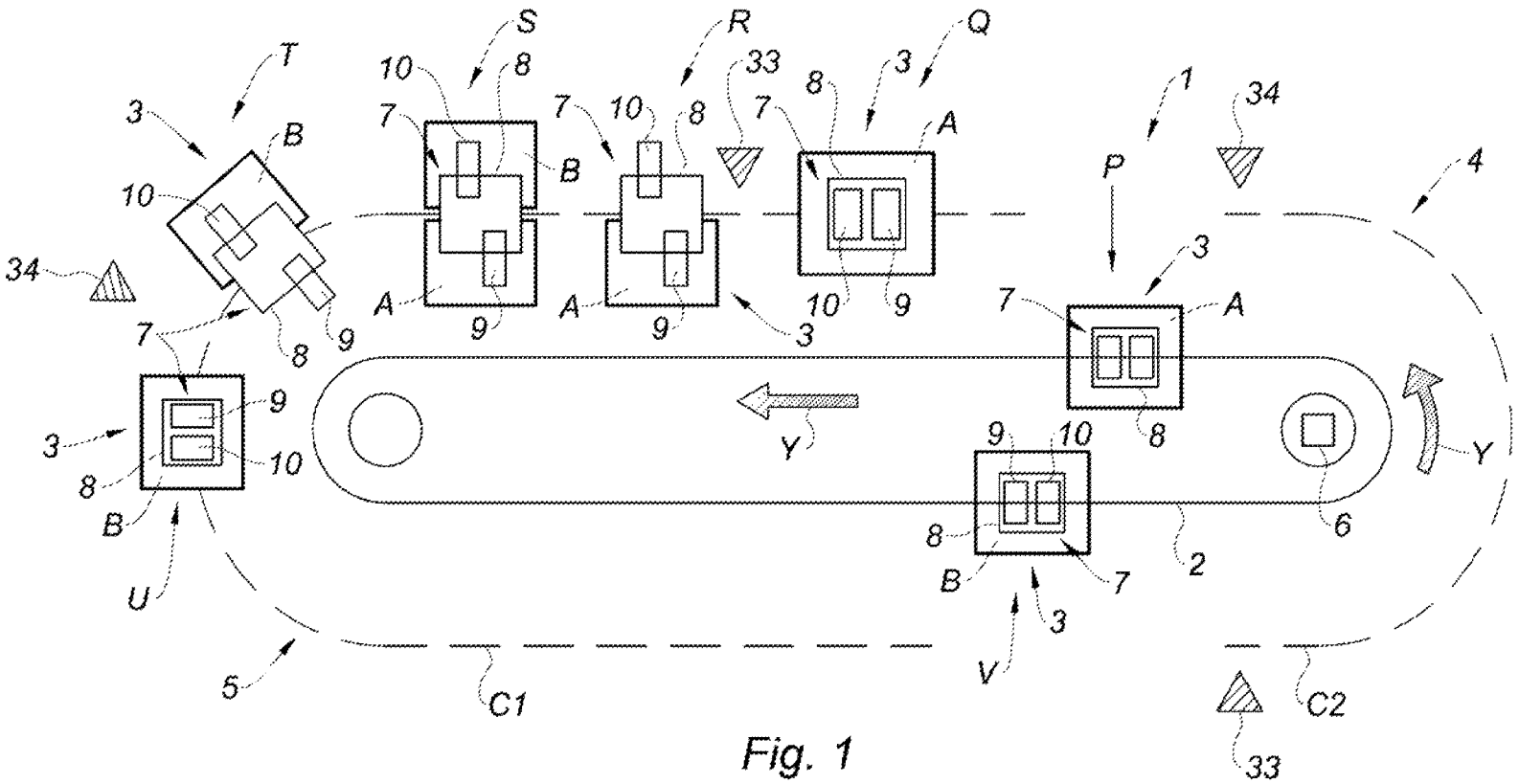
FIG. 1 schematically illustrates an embodiment of a transport installation by aerial cable according to the invention.
Figure 2:
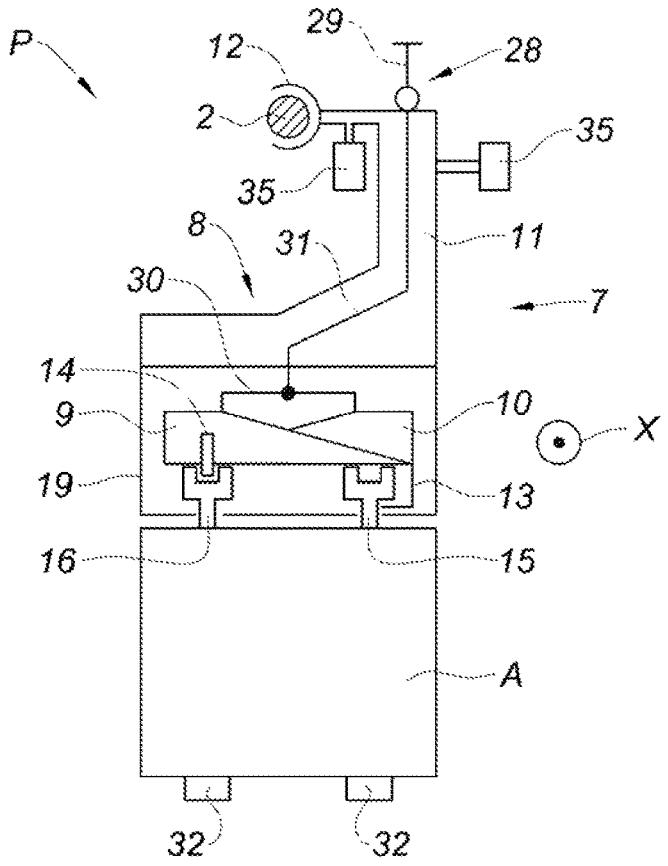
FIGS. 2 to 4 schematically illustrate front views of an embodiment of an attachment device in different positions on the running path of an aerial cable transport installation, and respectively in a position between two stations, a movement position in a station, and a stopped position in a station.
Figure 8:
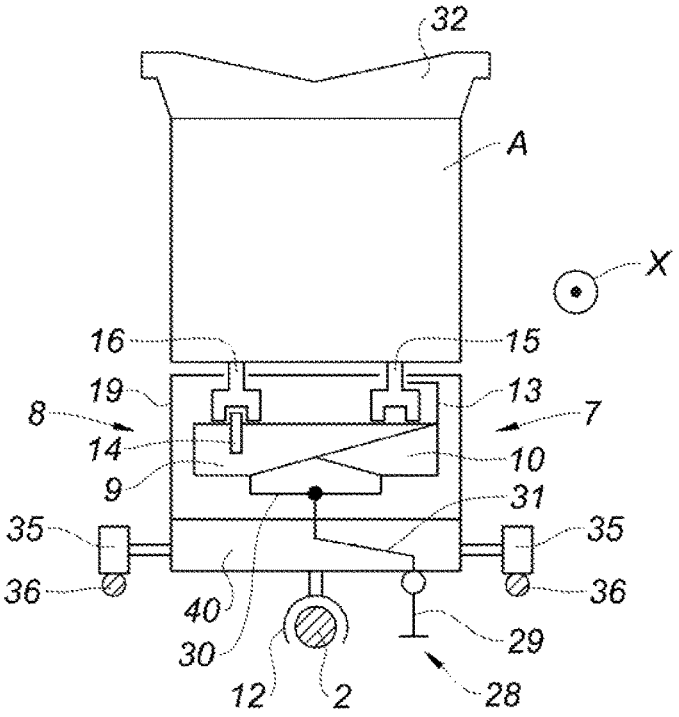
FIGS. 8 to 10 schematically illustrate front views of another embodiment of an attachment device in different positions on the running path of a transport installation by hauling cable on the ground, and respectively in a position between two stations, a movement position in a station, and a stopped position in a station.
Figure 9:
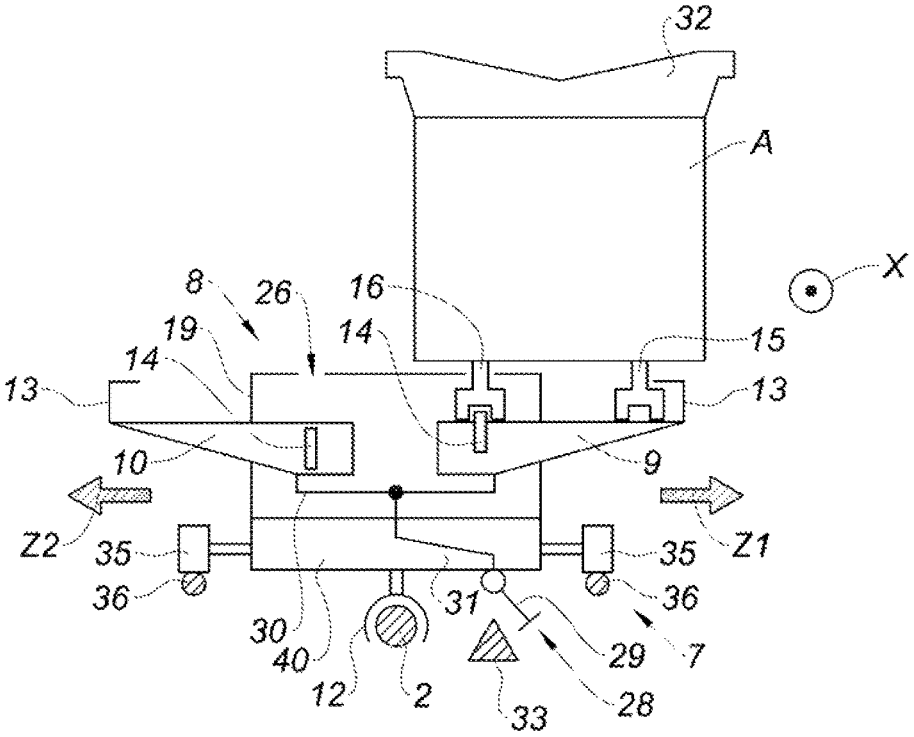
Figure 10:
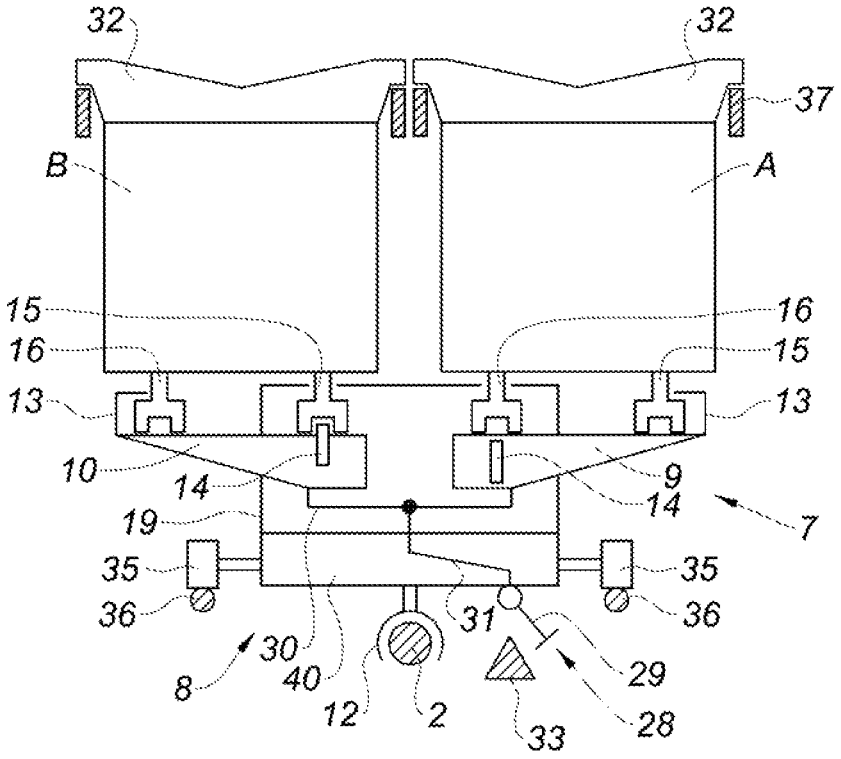

In FIG. 1, an embodiment of an installation 1 for transporting by cable 2 has been represented. The installation 1 comprises vehicles 3 designed to be hauled by cable 2 for transporting people or goods. The installation 1 can be of any type, for example of the monocable or bicable type, with fixed or detachable grips, with a continuous or back and forth cable. A monocable installation comprises a single cable which is both a carrying and hauling cable, and a bicable installation comprises at least one hauling cable and at least one carrying cable. A fixed grip installation comprises vehicles which are attached in permanent manner to the hauling cable, and a detachable installation comprises vehicles attached in removable manner to the hauling cable. A continuous cable installation comprises a hauling cable which forms a closed loop between two terminal stations of the installation and the vehicles run in continuous manner along the hauling cable. A back and forth installation comprises a vehicle which performs a back and forth run between two terminal stations on a single track. In FIG. 1, a detachable monocable installation 1 with a continuous cable 2 has been represented. The installation 1 comprises two terminal stations 4, 5 for unloading/loading of persons in the vehicles 3. The installation 1 further comprises a drive terminal 4 equipped with a motor 6 to drive the cable 2 in a direction of movement Y. The cable 2 can further be situated above the cabin of the vehicles 3, as illustrated in FIGS. 1 to 7, or below the cabin of the vehicles 3, as illustrated in FIGS. 8 to 10. For example, the vehicles 3 can be coupled to the cable 2 and kept above the ground, in which case the cable 2 is said to be aerial and the transport installation 1 is an aerial cableway. The cable 2 can also be situated at ground level, and the cable 2 is then said to be a ground-level hauling cable, i.e. the vehicles 3 are either supported by rails and the transport installation 1 is a funicular railway, or the vehicles 3 are guided by slides situated at ground level and the transport installation 1 is a train on an air cushion hauled by a cable.

Each vehicle 3 comprises a cabin A, B that is able to be a passenger compartment designed to receive passengers or a container designed to contain goods, for example waste products. At least one vehicle 3 of the installation 1 comprises a device 7 for attaching a cabin A, B designed to be hauled by the cable 2. The attachment device 7 comprises attachment means 8, for example a fastener, configured to couple the device 7 to the cable 2. Furthermore, when a cabin A, B is attached to the attachment device 7, the assembly forms a vehicle 3.

The attachment device 7 comprises at least one arm 9, 10 configured to attach a cabin A, B in removable manner. According to a preferred embodiment, the device 7 comprises two arms 9, 10 and each of the arms is configured to attach a cabin A, B in removable manner to the attachment device 7. More particularly, each arm 9, 10 of the device 1 is mounted mobile on the attachment means 8 to move a cabin A, B with respect to the attachment means 8. Advantageously, the arms 9, 10 of the device 7 can move a cabin A, B on one side or the other of the attachment means 8.

In FIG. 1, an example of routing of a vehicle, in particular the routings of two cabins A, B, along the hauling cable 2, has been represented. At an initial time, the first cabin A is attached to the cable 2 by the attachment device 8 and the second cabin B is located in a station 5, in an immobile position, i.e. parked in station 5. At the initial time, the first cabin A is located between the two stations, and the attachment device 7 is in a position P between two stations. Then the first cabin A is hauled by the cable 2 in the direction of movement Y, and arrives in the station 5. The vehicle 3 is then detached from the cable 2 and the vehicle 3 runs in a detached circuit C1 of the station 5. The other terminal station 4 also comprises a detached circuit C2. When the vehicle 3 is detached, the attachment means 8 are detached from the cable 2. The attachment device 7 is then in a second position Q. Then the attachment device 7 takes a third position R of movement in the station in which a first arm 9 which attaches the first cabin A moves the first cabin A with respect to the attachment means 8. The attachment device 7 then takes a fourth stopped position S in the station in which the attachment device 7 is stopped at the level of the second cabin B. In this second position S, the first cabin A can be detached from the first arm 9 and the second cabin B can be attached to the second arm 10. According to another mode of use of the attachment device 7, the first cabin A remains attached to the first arm 9 and the second cabin B remains immobile in the station 5, without being attached to the second arm 10. Then, in the case where the second cabin B is attached to the attachment device 7, instead of the first cabin A, the attachment device 7 is again driven in the detached circuit C1. The attachment device 7 then takes three other successive positions T to V. In the fifth position T, the second cabin B is moved in the detached circuit C1, and the first cabin A remains immobile in the station 5, in the mode where the second cabin B is attached. In the sixth position U, the second arm 10 resumes an initial position and moves the second cabin B with respect to the attachment means 8. In the seventh and last position V, the vehicle 3 comprising the second cabin B is attached to the cable 2 to be hauled to the other station 4.

Figure 5:
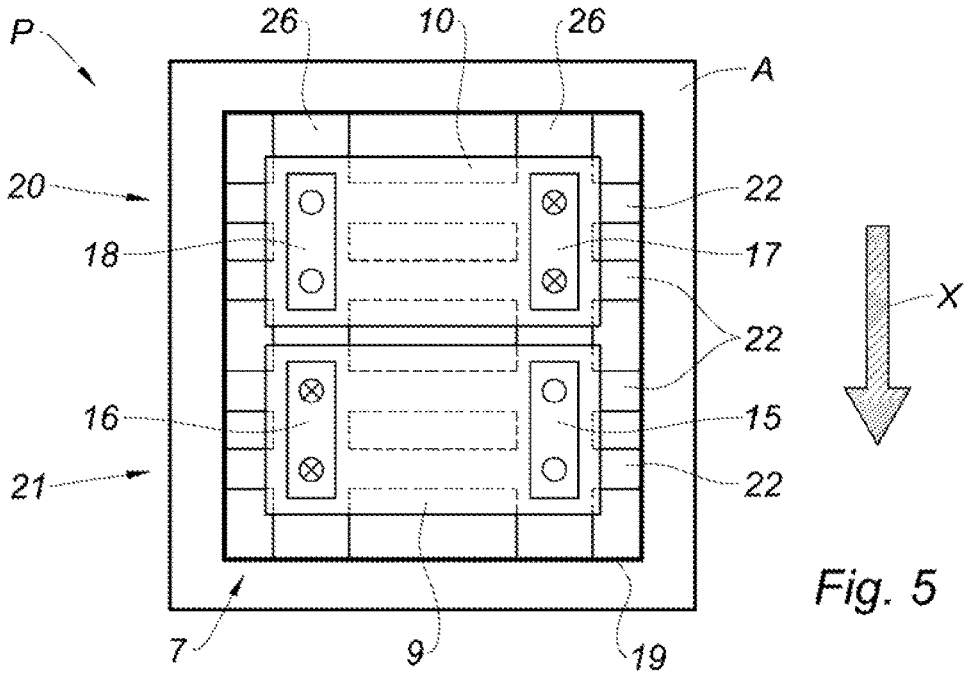
FIGS. 5 to 7 schematically illustrate top views of the attachment devices respectively illustrated in FIGS. 2 to 4.
Figure 6:
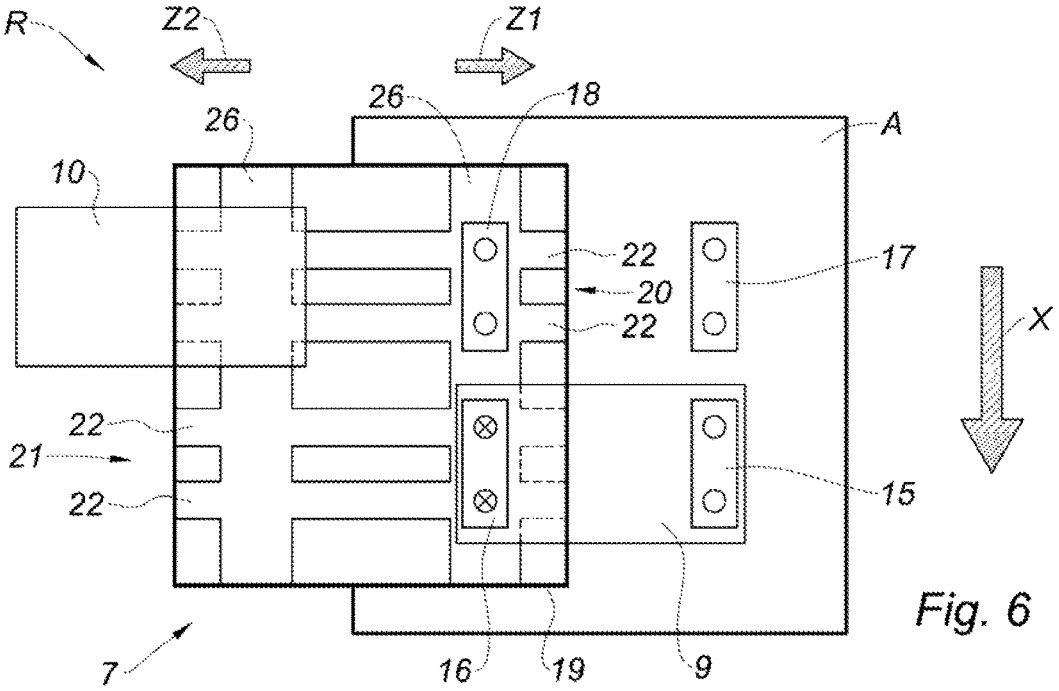
Figure 4:
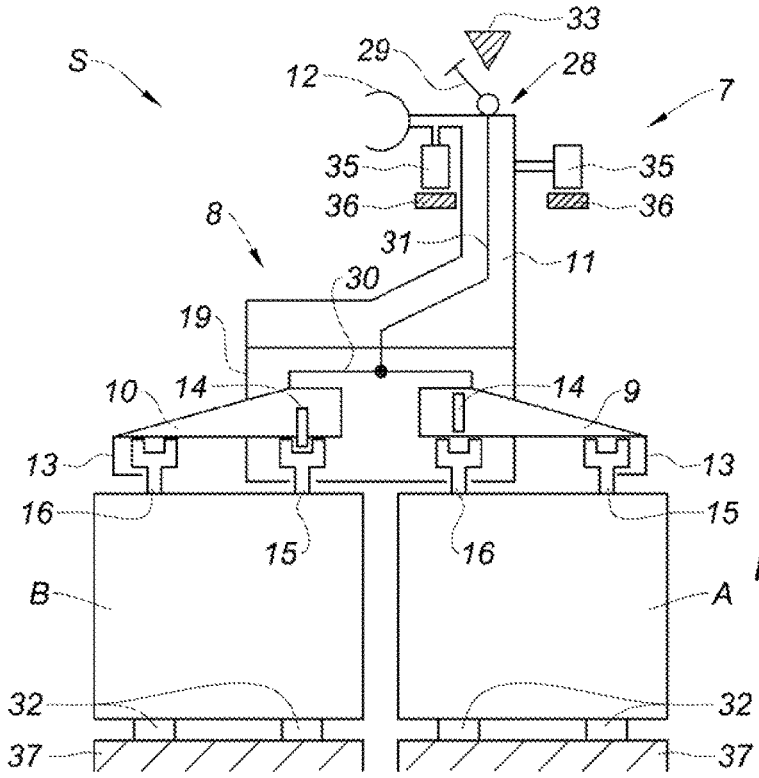
Figure 7:
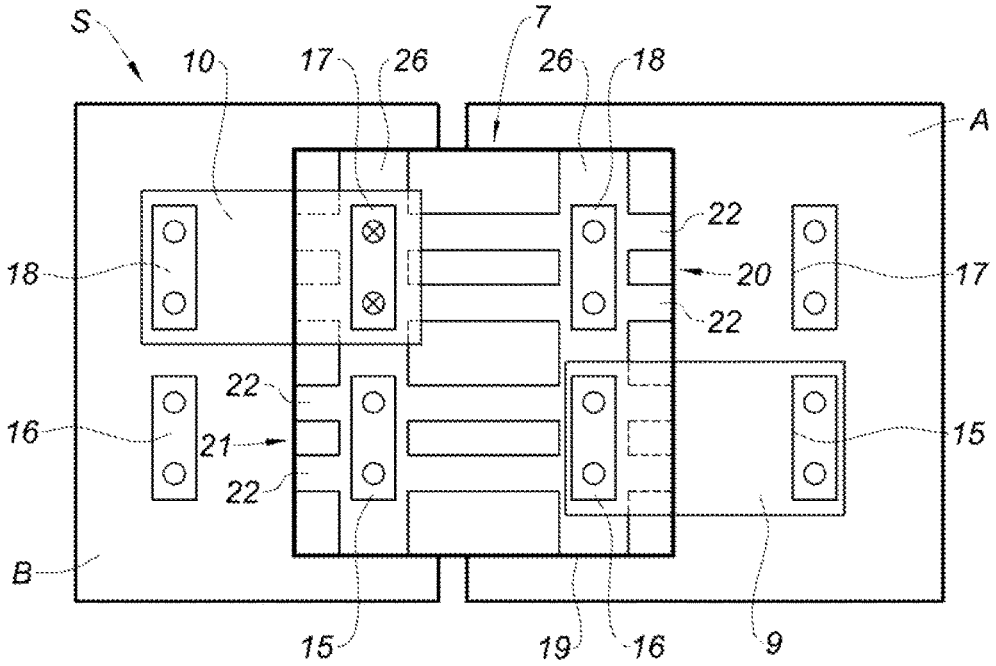

In FIGS. 2 to 7, a first embodiment of an attachment device 7 designed to be hauled by a cable 2 located above the cabins A, B of the vehicles 3 has been represented. In this first embodiment, the attachment means 8 comprise a hanger arm 11 and a grip 12 fixed to a first end of the hanger arm 11. The grip 12 clamps the cable 2 to couple the attachment device 7 to the cable 2. The grip 12 can be detachable to couple the device 7 to the cable 2 in removable manner, i.e. the attachment means 8 can be detached from the cable 2, in particular to transfer the attachment devices 7 onto a detached circuit C1, C2 where they can be driven at a low speed slower than that of the cable 2 which hauls them when the attachment devices 7 are on-line. What is meant by on-line attachment device 7 is an attachment device 7 coupled to the hauling cable 2 of the installation 1. As a variant, the grip 12 can be fixed to couple the attachment device 7 to the cable 2 in permanent manner, i.e. the attachment device 7 is mechanically connected in permanent manner on the cable 2. Furthermore, each arm 9, 10 comprises a hook 13 and a lock-out valve 14 respectively located at the two ends of the arm 9, 10. In particular, the cabin A comprises at least one pair of clamps 15, 16 which collaborate respectively with the hook 13 and the lock-out valve 14 of the arm 9, 10 onto which the cabin A is designed to be attached. Furthermore, each cabin A, B of the transport installation 1 can comprise at least one pair of clamps 15, 16 to be able to be attached to an arm 9, 10 of the attachment device 7. According to another preferred embodiment, the cabins A, B comprise two pairs of clamps 15 to 18, as illustrated in FIGS. 5 to 7. Each pair of clamps is configured to collaborate with an arm 9, 10. For example, each clamp 15 to 18 can comprise two studs salient from the cabin. Each stud comprises a head which provides a grip for a hook 13 so as to attach the cabin to the arm 9, 10. Furthermore, the head of the studs comprises a central recess to each received a part of a lock-out valve 14 so as to keep the cabin A attached to the arm 9, 10. In general manner, a cabin A, B can be attached in removable manner to an arm 9, 10 of the attachment device 7. When the cabin A, B is attached to the attachment device 7, it forms a vehicle 3, and when the cabin A, B is detached from the attachment device 7, it rests in immobile manner in a station 4, 5 of the transport installation 1. Furthermore, the arms 9, 10 can be identical. In particular, the arms 9, 10 are mounted in opposition within the attachment device 7. That is to say they are positioned in parallel manner to one another and in reverse direction.

Figure 3:
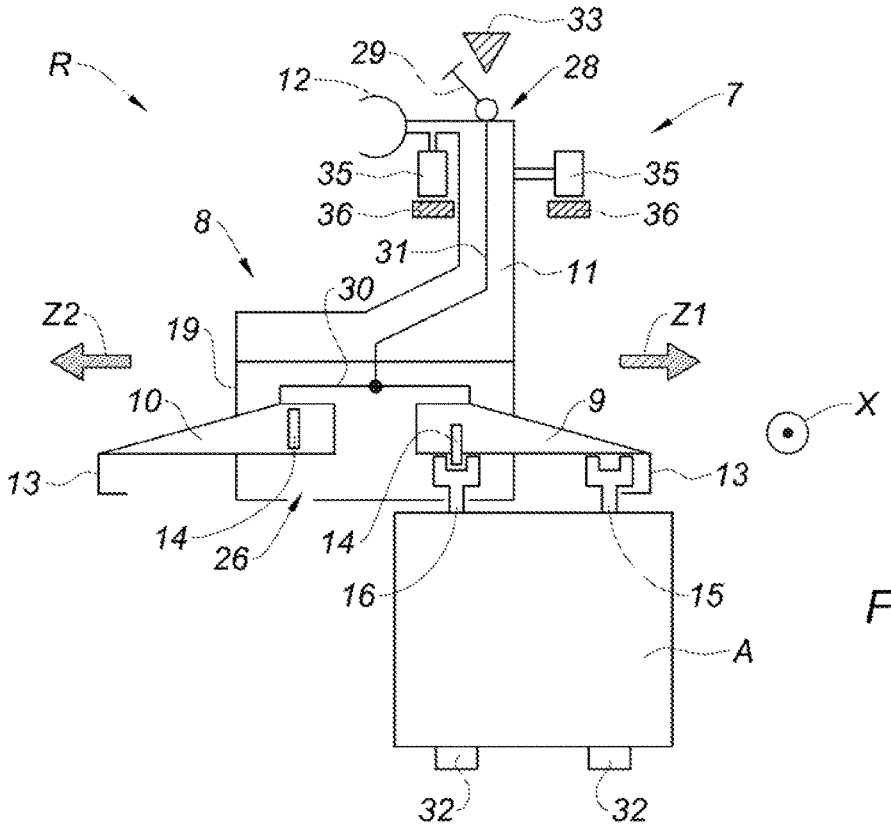

Advantageously, the attachment means 8 comprise a chassis 19 located at the level of the second end of the hanger arm 11. The chassis 19 can form part of the hanger arm 11 which is then monoblock. As a variant, the chassis 19 is an independent part fixed onto the hanger arm 11. In particular, the chassis 19 is a frame to house the arms 9, 10 and make them slide. In general manner, the chassis 19 comprises at least one slide 20, 21, fixed to the attachment means 8, in which an arm 9, 10 of the device 7 slides. When the device 7 comprises two arms 9, 10, the chassis 19 comprises two slides 20, 21 to respectively make the two arms 9, 10 slide. For example, the slides 20, 21 extend in the widthwise direction of the chassis 19. The arms 9, 10 are thus mounted sliding in the slides 20, 21 to move the cabin A, B, which they attach, perpendicularly to a direction X of movement of the attachment means 8. In FIG. 3, the spreading of the arms 9, 10 respectively in two opposite directions Z1, Z2 has been represented. Preferably, spreading of the arms 9, 10 is performed in synchronised manner. Furthermore, each arm 9, 10 can move away on one side of the attachment means 8, for example in the direction Z1, or on the other side in the opposite direction Z2. The chassis 19 further comprises at least two transverse grooves 22, and at least two longitudinal grooves 26. When the attachment means 8 comprise two arms 9, 10, the chassis 19 comprises four transverse grooves 22, and two longitudinal grooves 26. The transverse grooves 22 enable the clamps 15 to 18 of a cabin A, B, and more particularly the studs located salient from the cabin A, B, to translate within the chassis 19 perpendicularly to the direction X of movement of the attachment means 8. Furthermore, the longitudinal grooves 26 form a passage for the clamps 15 to 18, and more particularly the studs located salient from the cabin A, B, in order to enable the attachment device 7 to translate in the direction X of movement of the attachment means 8, when it is hauled at the level of a cabin B which is stopped in a station 4, 5. In other words, each arm 9, 10 is mounted sliding in a slide 20, 21 along an axis perpendicular to a vertical axis and to a coupling axis of the attachment means 8. The vertical axis is an axis which follows the direction of gravity. The coupling axis of the attachment means 8 is an axis along which the cable 2 extends when the attachment means 8 are coupled to the cable. The coupling axis is also referred to as clamping axis.

The attachment device 7 further comprises an actuating system 28 to open and close the arms 9, 10. The actuating system 28 enables the arms 9, 10 to be translated with respect to the attachment means 8. When the arms 9, 10 are situated within the chassis 19, they are in an initial position, i.e. they are closed. On the contrary, when the arms 9, 10 are translated to move a cabin A, B, they are in a translated position, and it is also said that the arms 9, 10 are open. The actuating system 28 comprises a lever 29, an actuator 30 and a flexible 31 which connects the lever 29 to the actuator 30. The actuator 30 enables the arms to be made to slide in two opposite directions Z1, Z2. Furthermore, the stations 4, 5 each comprise an opening cam 33 to activate opening of the arms 9, 10, and a closing cam 34 to activate closing of the arms 9, 10, illustrated in FIGS. 1; 3 and 4; 9 and 10. The opening and closing cams 33, 34 collaborate with the lever 29 to respectively activate opening and closing of the arms 9, 10. The lever 29 can switch from an initial position, illustrated in FIG. 2, in which the arms are closed, to an open position, illustrated in FIG. 3, in which the arms are open. An opening cam 33 is placed at the entrance to the station 4, 5 to switch the lever 29 to its open position and activate opening of the arms 9, 10. Another closing cam 34 is positioned on exit from the station 4, 5 to move the lever back to its initial position and close the arms 9, 10.

The cabin A, B can further comprise support means 32, for example a support, to keep the cabin immobile when it is detached from an arm 9, 10. Advantageously, the attachment means 8 comprise stabilising means 35, for example a stabilizer, to stabilise the attachment means 8 when the cabin A, B is moved with respect to the attachment means 8. For example, the stabilising means 35 comprise two wheels located on each side of the hanger arm 11, which can run on stabilising rails 36 of a station 4, 5.

Advantageously, when the transport installation 1 is detachable and comprises detached circuits C1, C2 equipped with rails to move the vehicles in the reduced-speed running sections, the rails of the detached circuits C1, C2 are used as stabilising rails 36. The stabilising rails 36 do in fact enable rocking of a cabin A, B to be prevented when it is moved by an arm 9, 10. The stations 4, 5 can also comprise receiving means 37 of a cabin A, B to keep the latter immobile when it is detached from an arm 9, 10.

In FIG. 7, a particular mode of use of the attachment device 7 has been represented wherein the attachment of the cabins A, B is inverted. In this case, the first cabin A is detached from the first arm 9 on which it was attached. For this, the valve 14 is unlocked from the clamp 16. Furthermore, the second arm 10 attaches the second cabin B, locking the valve 14 of the second arm 10 in the clamp 17. According to another mode of use, the cabins A, B are not inverted. In this case, the first cabin A remains attached to the first arm 9 and the attachment device 7 again drives the first cabin A leaving the second cabin B immobile in the station 5. In this other mode of use, a first cabin A can continue to run in a station 4, 5, passing next to a second cabin B located at a standstill in the station 4, 5. In this way, the stopped second cabin B does not hamper running of the first cabin A.

In FIGS. 8 to 10, a second embodiment of an attachment device 7 has been represented designed to be hauled by a cable 2 situated below the cabins A, B of the vehicles 3. Certain reference numerals of the parts described in the previous figures have been transferred to FIGS. 8 to 10. In this second embodiment, the attachment means 8 comprise a carriage 40 and a grip 12 fixed to a first end of the carriage 40. The grip 12 can be detachable or not to couple the attachment device 7 to the cable 2. The attachment device 7 comprises the same component parts as those described previously. The cabin A, B for its part comprises the same component parts, but in a different position. The support means 32 are in fact situated on a top part of the cabin A, B to keep the latter immobile when it is detached from an arm 9, 10. For example, the stabilising means 34 comprise two wheels located on each side of the carriage 40 and can run on carrying cables 36 of a station 4, 5. The carrying cables 36 act as stabilising rails 36 of the stations 4, 5. The carrying cables 36 do in fact prevent rocking of the cabin A, B when the latter is moved by an arm 9, 10. The stations 4, 5 can also comprise receiving means 37 of a cabin A, B to keep the latter immobile when it is detached from the arms 9, 10.

The invention that has just been described in the foregoing is particularly suitable for any type of cable transport installation, in particular a detachable or non-detachable installation. The invention enables the cabins parked in the stations to be avoided, without stopping running of the other cabins, and enables the throughput rate of the installation to be increased. Furthermore, the invention reduces the time during which the hauling cable is stopped or slowed down for loading or unloading of passengers.

The invention claimed is:

1. A device for attaching a cabin designed to be hauled by a cable, comprising:

a fastener to couple the device to the cable;

at least one arm configured to attach the cabin in removable manner and mounted mobile on the fastener to move the cabin with respect to the fastener; and at least one slide fixed to the fastener, and wherein said at least one arm is mounted sliding in said at least one slide along an axis perpendicular to a vertical axis and to a coupling axis of the fastener, wherein said at least one arm is able to slide along the axis perpendicular to the vertical axis and the coupling axis of the fastener for moving the cabin attached thereof so that the cabin attached thereof avoids another cabin.

2. The device according to claim 1, comprising two slides fixed to the fastener and two arms mounted respectively sliding in the slides along respectively two axes perpendicular to the vertical axis and to the coupling axis of the fastener.

3. The device according to claim 2, comprising an actuator to make the arms slide in two opposite directions.

4. The device according to claim 1, comprising a stabilizer to stabilise the fastener when the cabin is moved with respect to the fastener.

5. A vehicle designed to be hauled by a cable, comprising:

a device according to claim 1; and a cabin attached to at least one arm of the device.

6. The vehicle according to claim 5, wherein the cabin comprises supports to keep the cabin immobile when it is detached from said at least one arm.

7. The vehicle according to claim 5, wherein the cabin is configured for transport of people.

8. Installation for transporting by cable, comprising at least one vehicle according to claim 5.

9. The installation according to claim 8, wherein the cable is a hauling cable located above the cabin of said at least one vehicle.

10. The installation according to claim 8, wherein the cable is a hauling cable located below the cabin of said at least one vehicle.

11. The installation according to claim 8, comprising two terminal stations wherein the cable forms a closed loop between the two terminal stations.

12. The installation according to claim 8, wherein the fastener of said at least one vehicle is configured to couple the device for attaching the cabin of said at least one vehicle to the cable in removable manner.

* * * * *